US005262605A

United States Patent [19]

Pham et al.

[11] Patent Number: 5,262,605

[45] Date of Patent: Nov. 16, 1993

[54] SURGE-LIMITING CIRCUIT BREAKER

[75] Inventors: Van Doan Pham; Joseph Martin, both of Meyzieu; Jean-Marc Willieme, La Mulatiere; Jocelyn Tremblay, Lyons; Gerhard Seyrling, Villeurbanne, all of France

[73] Assignee: GEC Alsthom SA, Paris, France

[21] Appl. No.: 607,329

[22] Filed: Oct. 31, 1990

[30] Foreign Application Priority Data

Nov. 3, 1989 [FR] France ..... 89 14433

[51] Int. Cl.[5] ..... H01H 33/16; H01H 9/42

[52] U.S. Cl. ..... 200/144 AP; 200/148 R

[58] Field of Search ..... 200/144 AP, 148 A, 148 B, 200/148 R, 146, 150

[56] References Cited

U.S. PATENT DOCUMENTS

| | | | |
|---|---|---|---|
| 4,338,500 | 7/1982 | Pham et al. | 200/144 AP |
| 4,421,962 | 12/1983 | Thuries et al. | 200/144 AP |
| 4,439,651 | 8/1982 | Thuries et al. | 200/144 AP |
| 4,442,330 | 4/1984 | Oshita et al. | 200/148 A |
| 4,608,470 | 8/1986 | Bischofberger et al. | 200/144 AP |
| 4,831,487 | 5/1989 | Ruoss | 361/111 |

FOREIGN PATENT DOCUMENTS

| | | |
|---|---|---|
| 0071867 | 2/1983 | European Pat. Off. . |
| 0157922 | 10/1985 | European Pat. Off. . |
| 2754431 | 6/1979 | Fed. Rep. of Germany . |
| 2835064 | 2/1980 | Fed. Rep. of Germany . |
| 2503448 | 10/1982 | France . |
| 2612683 | 9/1988 | France . |
| 665053 | 4/1988 | Switzerland . |

*Primary Examiner*—A. D. Pellinen
*Assistant Examiner*—Michael A. Friedhofer
*Attorney, Agent, or Firm*—Sughrue, Mion, Zinn, Macpeak & Seas

[57] ABSTRACT

A surge limiting circuit breaker has, for each phase, at least one interrupting chamber constituted by a gastight insulating enclosure filled with a gas having high dielectric strength. The enclosure contains fixed and moving main contacts and fixed and moving arcing contacts. Moving equipment effects movement of the moving contacts relative to the fixed contacts. The enclosure includes a varistor. The varistor is inserted in parallel with the circuit breaker contacts on separation of the main contacts when the circuit breaker is being opened, disconnecting the varistor before the end of the stroke of the moving arcing contact. The varistor is inserted in parallel with the circuit breaker contacts while closing the circuit breaker and prior to bringing the arcing contacts into contact with each other. The varistor is short-circuited when the arcing contacts come into contact.

20 Claims, 3 Drawing Sheets

SURGE-LIMITING CIRCUIT BREAKER

The present invention relates to a surge-limiting circuit breaker.

BACKGROUND OF THE INVENTION

It is known that a resistor whose resistance varies with the voltage across its terminals, i.e. a "varistor", may be connected in parallel with the interrupting chamber of a circuit breaker. The varistor is generally based on zinc oxides and serves to avoid arcs being struck on the circuit breaker contacts, thereby avoiding premature wear thereof. When the circuit breaker is connected in series with an inductive circuit such as an unloaded transformer, a reactor, or a motor, the varistor protects such a circuit against the surges that may arise during a circuit in breaking or opening operation.

The use of a varistor in this manner is described, for example, in the "Technique de l'Ingenieur" series, Vol. E 2110, "Varistors", at page 13, and also in U.S. Pat. No. 4,831,487.

When the circuit breaker is used to protect a line, it is subjected to surges that may be high, in particular when interrupting lines that are unloaded or are in phase opposition. In order to avoid the varistor being almost permanently in operation, it is necessary to put a switch in series therewith to isolate it from the circuit when the circuit breaker is in the open position. This requirement leads to conventional type apparatuses being made having an additional device which is bulky and not cheap.

An object of the invention is to provide a cheap circuit breaker which limits voltage by means of a varistor and in which the varistor is inserted in circuit automatically when the circuit breaker is opened and is also removed from the circuit automatically.

Normally a varistor associated with a circuit breaker interrupter chamber is placed in an insulating porcelain column disposed parallel to the interrupting chamber and in atmospheric air. This column is subjected to pollution, and the appearance of pollution on one or more locations of the porcelain changes the distribution of potential thereover and this may give rise to zones of stress or heating, with the possibility of the varistor suffering thermal runaway and destruction.

Another object of the invention is to provide a circuit breaker in which voltage is limited by a varistor and in which the varistor is not subjected to pollution.

Another object of the invention is to provide a circuit breaker in which voltage is limited by a varistor and in which the physical size of the varistor is smaller than the size of varistors used in the prior art.

SUMMARY OF THE INVENTION

The above objects are achieved by means of a surge limiting circuit breaker comprising, for each phase, at least one interrupting chamber constituted by a gastight insulating enclosure filled with a gas having high dielectric strength, and containing fixed and moving main contacts and fixed and moving arcing contacts, together with drive means for the moving contacts, wherein said enclosure encloses a varistor and varistor insertion means for:

inserting the varistor in parallel with the circuit breaker contacts on separation of the main contacts when the circuit breaker is being opened, and disconnecting the varistor before the end of the stroke of the moving arcing contact; and inserting the varistor in parallel with the circuit breaker contacts while closing the circuit breaker and prior to bringing the arcing contacts into contact with each other, the varistor being short-circuited when the arcing contacts come into contact.

BRIEF DESCRIPTION OF THE DRAWINGS

A preferred embodiment of the invention is described by way of example with reference to the accompanying drawings, in which.

DETAILED DESCRIPTION

Figure 1:
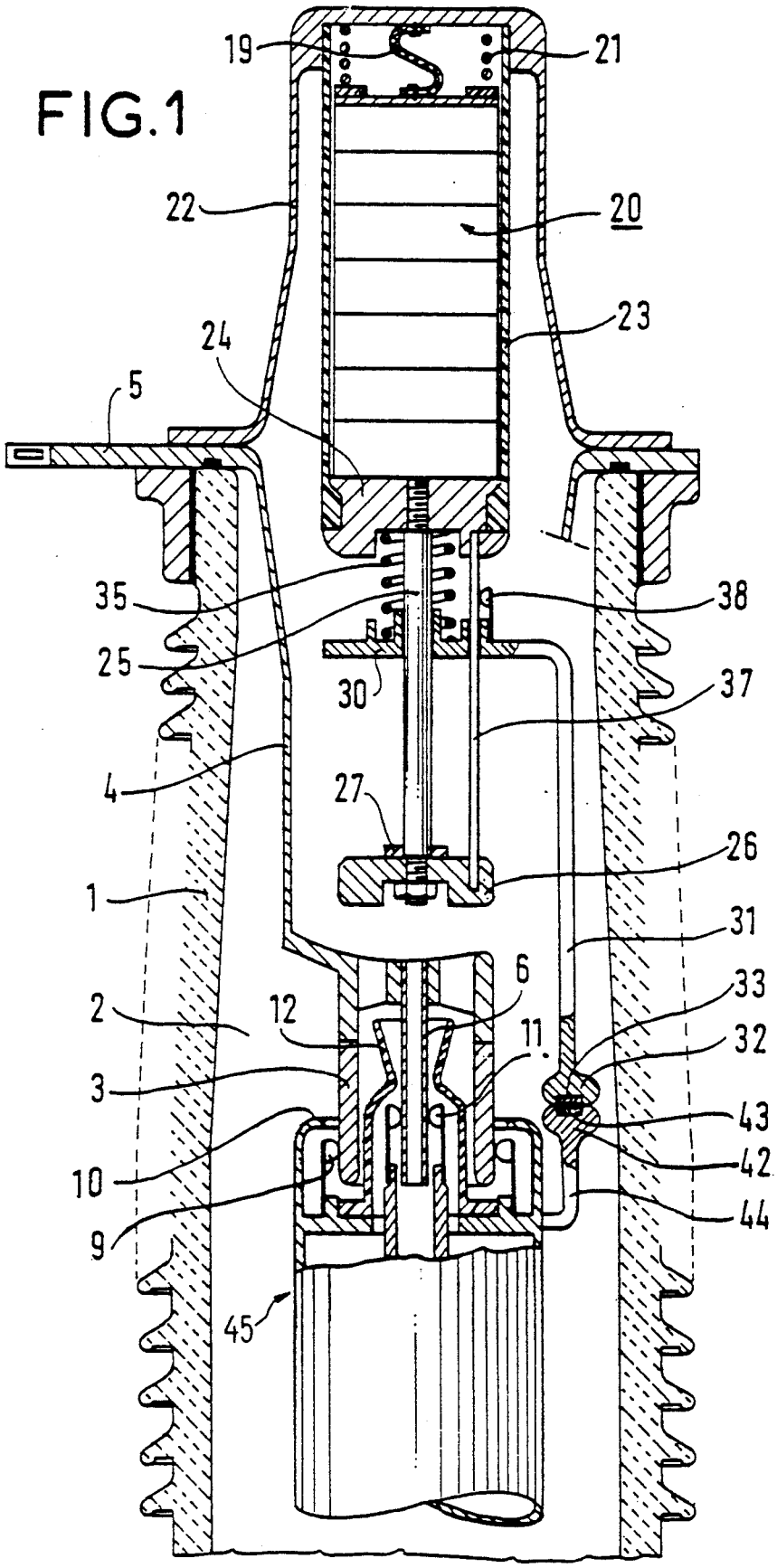
FIG. 1 is an axial section view of a circuit breaker of the invention shown in the engaged position.

The circuit breaker of FIG. 1 comprises an insulating enclosure 1 preferably made of porcelain and delimiting an inside volume 2 which is filled with a gas having a high dielectric constant, e.g. sulfur hexafluoride, and at a pressure of a few bars.

The circuit breaker comprises a fixed main contact or tube 3 which is mechanically and electrically connected by an arm 4 to a therminal 5 of the circuit breaker. The contact 3 is fixed to a fixed arcing contact 6 likewise constituted by a tubular part. The fixed arching contact 6 is electrically connected to the contact 3.

The moving equipment of the circuit breaker comprises a drive means indicated generally at 45 and includes a main moving contact a constituted by contact fingers protected by an anticorona cap 10 and engaging tube 3. It also includes a moving arcing contact 11 constituted by fingers which engage fixed arcing contact 6 and which co-operate with a blast nozzle 12. The blast means do not constitute part of the present invention and they are not shown. They are made in conventional manner known to the person skilled in the art. The moving equipment is connected to an operating rod (not shown). The moving electrical contacts are connected to a second current terminal (not shown).

In accordance with one of the characteristics of the present invention, a varistor 20 is placed inside the interrupting chamber. This varistor is preferably constituted by a stack of metal oxide pellets based on zinc oxide (ZnO). At the top of the chamber, a spring 21 presses down on the stack and up against a metal cap 22 closing the chamber and electrically connected to current terminal 5. A metal braid 19 ensures electrical continuity between the varistor 20 and the cap 22.

The pellets are held and guided in an insulating tube 23 which is closed at its bottom end by a metal endpiece 24.

The mechanism for inserting the varistor into circuit and for removing it from circuit is now described. This mechanism comprises an axial guide rod 25 fixed to the endpiece 24 and terminated by an abutment 26 which is provided with a shock absorber 27, e.g. a plate made of elastomer. The rod serves to guide a semimoving equipment comprising a slide 30 provided with a plurality of arms 31 (preferably two arms) serving to support a contact ring 32 which is preferably made of copper. Pellet-shaped magnets 33 are inserted in the ring 32.

The slide 30 is urged downwards in the figure by a spring 35 bearing against the endpiece 24. A metal rod 37 connects the endpiece 24 to the abutment 26. The slide 30 slides over said rod and carries sliding contacts 38 which establish an electrical connection between the varistor 20 and the arm 31.

The circuit breaker is completed by a ring 42 provided with pellet-shaped magnets 43 and carried by metal arms 44 in electrical connection with the moving contacts.

By construction, the lengths of the arms 31 and 44 are such that when the circuit breaker is in the disengaged position (FIG. 2) the distance B between the rings 32 and 42 is less than the distance C between the arcing contacts 6 and 11.

The circuit breaker operates as follows:

1. Closing the circuit breaker

Figure 2:
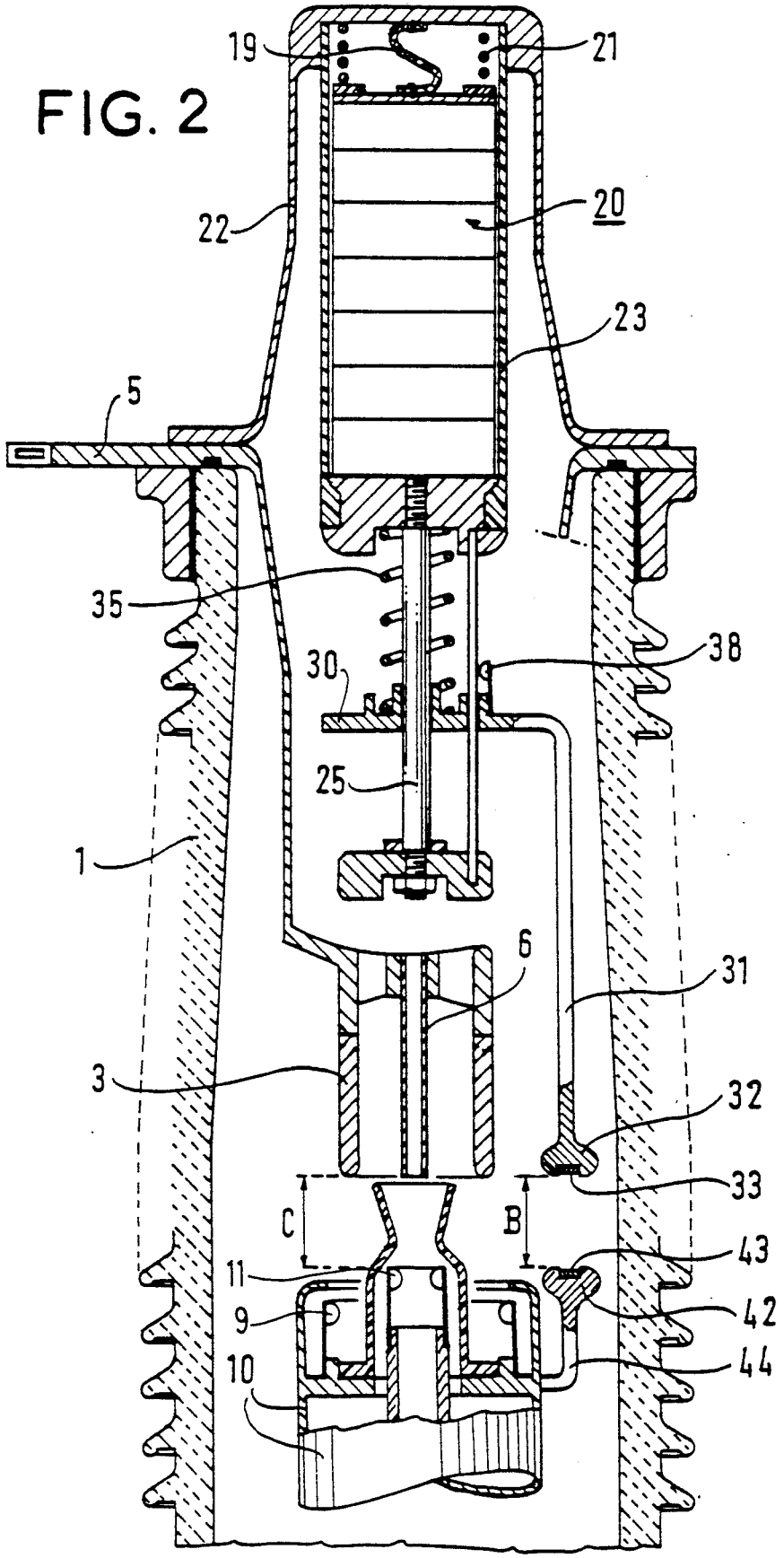
FIG. 2 is an axial section view of the same circuit breaker in the disengaged position.

Reference is made to FIG. 2.

On closing, the moving equipment is pushed upwards in the figure.

Contact is made successively between the rings 32 and 42, then between the arcing contacts 6 and 11, and finally between the main contacts 3 and 9. During the closing stroke, the spring 35 is progressively compressed. When contact is made between the rings 32 and 42, the varistor is inserted in the electrical circuit and current flows via the ring 42, the ring 32, the arm 31, the sliding contact 38, the rod 37, the endpiece 24, the varistor 20, the braid 19, the cap 22, and the terminal 5.

Once the arcing contacts 6 and 11 make contact, the varistor is short-circuited.

2. Opening the circuit breaker

When the circuit breaker is opened, the moving equipment is pulled downwards in the figure.

Expansion of the spring 35 and attraction between the magnets 33 and 43 enable the arms 31 to follow the downwards motion of the moving equipment.

By virtue of the magnetic attraction, the rest position as shown in FIG. 1 is passed, and the slide 30 reaches the shock absorber 27 on the abutment 26, pulling against the spring 35. The circuit breaker is adjusted so that the contact between the slide 30 and the shock absorber 27 takes place about 2 ms before the end of the opening stroke. With the moving equipment continuing its stroke, the rings 32 and 42 separate from each other and the slide 30 returns to its rest position under drive from the spring (i.e. to the position shown in FIG. 2).

When interrupting electrical current, and specifically when the arc on the arcing contact is extinguished, the reestablished voltage is applied across the varistor 20. If this voltage exceeds the nominal operating voltage of the varistor 20, a current will flow between the rings 32 and 42. However, if this voltage becomes less than the nominal voltage of the varistor 20, then the varistor causes to conduct and becomes insulating again.

When the slide 30 reaches its rest position (FIG. 2), the distance between the two rings 32 and 42 is sufficient to withstand the applied voltage without requiring the varistor to operate.

Figure 3:
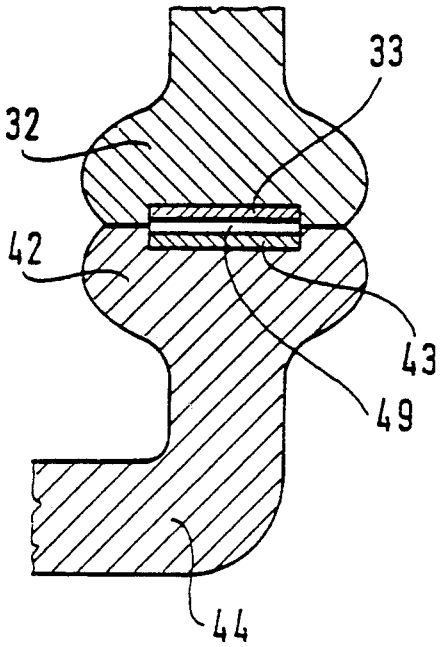
FIG. 3 is a fragmentary section of one end of a varistor-inserting arm.

As shown in FIG. 3, the magnets are disposed in the rings 32 and 42 in such a manner that when the rings come into contact a small gap 49 remains between the magnets 33 and 43. As a result, arcing takes place preferentially between the copper portions of the rings.

Figure 4:
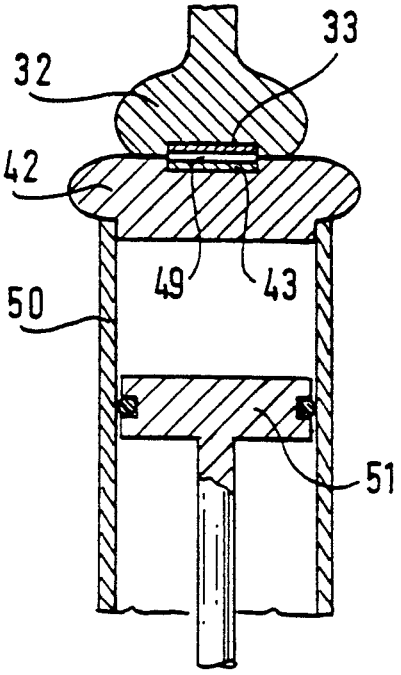
FIG. 4 is a fragmentary view in section of the end of a variant varistor-inserting arm.

In order to increase the dielectric performance of the interrupting gap B, excess pressure may be established in the space between the rings. To do this, as shown in FIG. 4, the ring 42 is fixed to an annular cylinder 50 which moves with the moving equipment. A piston 51 connected to stationary portions of the circuit breaker serves to inject jets of compressed gas via holes 52 formed through the ring 43.

Figure 5:
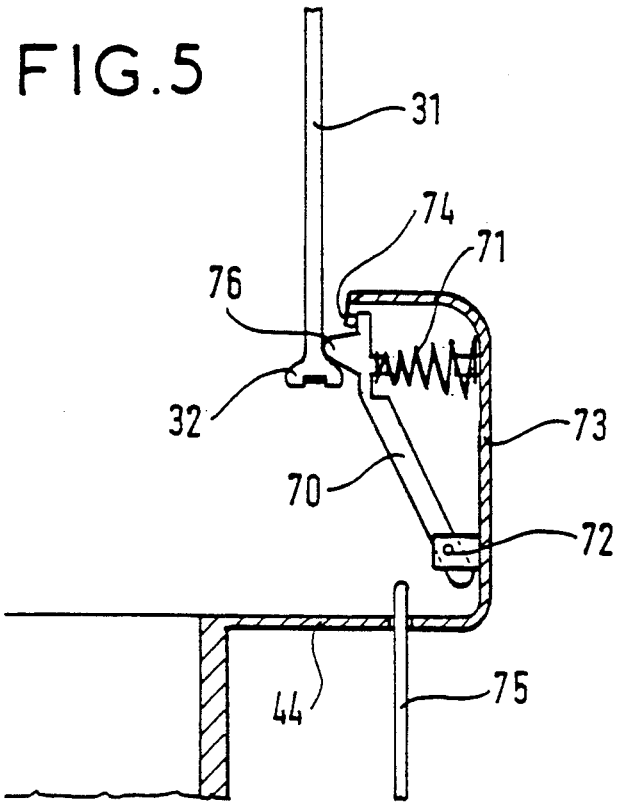
FIG. 5 is a diagrammatic view of a catch device for a variant insertion arm.

FIG. 5 shows another device for holding the contacts together in the engaged position.

An anticorona cap 73 carrying a pivot pin 72 is fixed to the arm 44, and a fastening finger terminated by an endpiece 76 is hinged thereon. A spring 71 urges the endpiece against the ring 32 and thus ensures that it is fastened thereto. A hoop 74 serves as an abutment for the endpiece 76.

Before the end of the opening stroke, an insulating rod 75 bears against the finger 70 to move the endpiece 76 away from the ring 32, thereby releasing the arms 31 which return to their rest position.

It should be observed that when interrupting passive circuits such as a bank of capacitors, a reactance, or an unloaded transformer in which the re-established voltage does not exceed 1 p.u., there is no need to have an insulating and current interrupting gap B. The rings 32 and 42 may be fixed together by replacing them with a single tube. The spring 35 and the shock absorber 27 would no longer be required.

It is thus possible to connect the endpiece 24 to the moving contact current terminal electrically by means of a piece constituted by two arms 31 terminated by a tube surrounding the anticorona means 10.

By putting the varistor in the dielectric gas under pressure and inside a metal column 22, it is possible to reduce the size of the varistor and to avoid atmospheric pollution.

The invention offers the following advantages:

1. When interrupting a current

When interrupting a current the voltage that appears across terminals of the circuit breaker is limited to a predetermined value, e.g., 1.6 p.u., i.e. 1.6 Un $\sqrt{2}/\sqrt{3}$, where Un is the nominal voltage of the network.

In Report No. 146 of the International Conference of Large Electricity Grids (CIGRE), 1958 session, the authors propose limiting surges to 1.9 p.u. by means of circuit breakers fitted with circuit-opening resistance.

In the event of interrupting a three-phase fault, the first pole to be interrupted will have a recovery transient voltage of may be as much as $1.5 \times 1.5$ p.u. applied thereto. The variator then limits all surges over 1.6 p.u.

In phase opposition or when interrupting an unloaded line, the voltage re-established across the terminals of the circuit breaker may be as much as 2 p.u. or more.

When interrupting on a reactance, the surge may exceed 2 p.u.

In any event, the presence of the varistor prevents the voltage across the terminals from exceeding 1.6 p.u. and thus, in many cases, prevents direct arc striking on the arcing contacts, which would otherwise give rise to wear and steep surge fronts on the grid.

Another advantage of having a varistor present lies in a line interrupt cycle of the O 0.3s C O type during the first opening operation, where by virtue of the operation of the varistor, the line remains charged only to a value which is not greater than about 0.5 p.u. instead of 1 p.u.

As a result, the closure operation taking place 0.3 seconds later gives rise to a smaller "downstream" surge. In certain conditions, the closure resistance normally used on very high tensión networks can be omitted, or else synchronized closure may be avoided.

At very high tension, all circuit breakers have a plurality of chambers connected in series. Here again surge on closing on unloaded lines can be reduced by causing varistors to operate.

To do this, the closure of one or two chambers (depending on the number of chambers per phase) is delayed by about 1 ms to 2 ms such that the corresponding varistor(s) inserted last has (have) a high voltage applied thereto which exceeds the nominal operating value.

A resistance is thus inserted into the circuit, thereby reducing the surge.

The insertion time of the varistor on closure depends on the difference between the distances B and C and on the engagement speed of the moving contacts.

2. With the circuit breaker in the open position

Since the interrupting gap B withstands lightening shock and operating shock less well than the arcing contacts, in the event of a voltage surge exceeding the standardized value, the presence of the varistor also serves to limit the surge by absorbing energy therefrom.

3. Pollution

The damage due to pollution of porcelain as used with prior art varistors is eliminated.

We claim:

1. A surge limiting circuit breaker comprising, for each phase, at least one interrupting chamber constituted by a gastight insulating enclosure filled with a gas having high dielectric strength, and containing fixed and moving main contacts, and fixed and moving arcing contacts, drive means for driving the moving contacts, wherein said enclosure encloses a varistor and said circuit breaker further comprises means for inserting the varistor in parallel with the circuit breaker contacts on separation of the main contacts when the circuit breaker is being opened, and disconnecting the varistor before the end of the stroke of the moving arcing contact and for inserting the varistor in parallel with the circuit breaker main contacts while closing the circuit breaker and prior to bringing the arcing contacts into contact with each other, the varistor being short-circuited when the arcing contacts come into contact, and wherein said inserting means comprise a first insertion contact mechanically fixed to the moving contacts and electrically connected thereto, and a second insertion contact which is semimoving relative to the circuit breaker fixed contacts and which is electrically connected to said circuit breaker fixed contacts, and wherein said insertion contacts are rings carrying magnets.

2. A circuit breaker according to claim 1, wherein said varistor is disposed between the cap of the enclosure and the fixed contacts of the circuit breaker.

3. A circuit breaker according to claim 1, wherein said varistor is constituted by a stack of pellets enclosed in an insulating tube.

4. A circuit breaker according to claim 3, wherein said stack is compressed by a spring bearing against a metal cap connected to a current terminal of the circuit breaker.

5. A circuit breaker according to claim 3, wherein said insulating tube is closed at one end by a metal endpiece.

6. A circuit breaker according to claim 1, wherein when the circuit breaker is in its open position, said second contact takes up a rest position such that the distance between said first contact and said second contact is less than the distance between the arcing contacts.

7. A circuit breaker according to claim 1, wherein said second contact is carried by a slide sliding on a guide rod which is coaxial with the enclosure and which is fixed to said endpiece, a spring being interposed between said slide and said endpiece.

8. A circuit breaker according to claim 7, wherein said guide rod is terminated by an abutment provided with a shock absorber.

9. A circuit breaker according to claim 8, wherein said slide carries sliding contacts co-operating with a rod extending between said abutment and said endpiece and passing through said slide.

10. A circuit breaker according to claim 1, wherein a gap is left between said magnets when said insertion contacts are in contact with each other.

11. A circuit breaker according to claim 1, including injection means for injecting a compressed gas into a zone between said insertion contacts during a circuit breaker opening operation.

12. A circuit breaker according to claim 11, wherein said injection means comprise a cylinder fixed to the insertion contact which is connected to the moving contacts, said cylinder co-operating with a fixed piston.

13. A circuit breaker according to claim 1, wherein at least one chamber of a phase has a closure instant which is delayed relative to the closure instant of the other chambers.

14. A circuit breaker according to claim 1, wherein the moving insertion contact includes at least one pivoting finger urged by a spring and terminated by a latching abutment for engaging the semimoving insertion contact ring, and a fixed rod engagable with said finger to release the semimoving insertion contact ring.

15. A surge limiting circuit breaker comprising, for each phase, at least one interrupting chamber constituted by a gastight insulating enclosure having a top cap and being filled with a gas having high dielectric strength, and containing fixed and moving main contacts, and fixed and moving arcing contacts, drive means for driving the moving contacts, wherein said enclosure encloses a varistor disposed coaxially with said enclosure between said top cap and said fixed contacts, said varistor being constituted by a stack of pellets enclosed in an insulating tube, closed at one end by a metal endpiece, said stack being compressed by a spring bearing against a metal cap connected to a current terminal of the circuit breaker, said circuit breaker further comprising insertion means for inserting the varistor in parallel with the circuit breaker contacts on separation of the main contacts when the circuit breaker is being opened, and disconnecting the varistor before the end of the stroke of the moving arcing contact and for inserting the varistor in parallel with the circuit breaker main contacts while closing the circuit breaker and prior to bringing the arcing contacts into contact with each other, said insertion means comprising a first insertion contact mechanically fixed to the moving contacts and electrically connected thereto, and a second insertion contact which is semimoving relative to the fixed contacts and which is electrically connected to said fixed contacts, said first and second insertion contacts being such that, when the circuit breaker is in its open position, said second insertion contact takes up a rest position such that the distance between said first insertion contact and said second insertion contact is less than the distance between the arcing contacts, and said insertion contacts being rings carrying magnets.

16. A surge limiting circuit breaker according claim 15, wherein said first and second insertion contacts are positioned in said enclosure relative to each other such that a gap exists between said magnets when said first and second insertion contacts are in contact with each other.

17. A surge limiting circuit breaker according to claim 16, further including injection means for injecting a compressed gas into a zone between said insertion contacts during a circuit breaker opening operation.

18. A surge limiting circuit breaker according to claim 17, wherein said injection means comprise a cylinder fixed to the insertion contact which is connected to the moving contacts, and said cylinder engages with a fixed piston.

19. A surge limiting circuit breaker according to claim 15, wherein at least one chamber of a phase has a closure instant which is delayed relative to the closure instant of the other chambers.

20. A surge limiting circuit breaker according to claim 19, wherein the moving insertion contact includes at least one pivoting finger urged by a spring and terminated by a latching abutment adapted to engage the semimoving insertion contact ring under the bias of said spring, and a fixed rod engagable with said finger to release the semimoving ring from said latching abutment.

* * * * *